US011154926B2

(12) United States Patent
Shentu et al.

(10) Patent No.: US 11,154,926 B2
(45) Date of Patent: Oct. 26, 2021

(54) CONTROL METHOD AND APPARATUS FOR INHIBITING SLAG ENTRAPMENT IN LADLE IN LAST STAGE OF POURING DURING CONTINUOUS CASTING

(71) Applicant: BAOSHAN IRON & STEEL CO., LTD., Shanghai (CN)

(72) Inventors: Lifeng Shentu, Shanghai (CN); Jikang Hu, Shanghai (CN); Jiaqi Xi, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 114 days.

(21) Appl. No.: 16/344,512

(22) PCT Filed: Oct. 13, 2017

(86) PCT No.: PCT/CN2017/106043
§ 371 (c)(1),
(2) Date: Apr. 24, 2019

(87) PCT Pub. No.: WO2018/077044
PCT Pub. Date: May 3, 2018

(65) Prior Publication Data

US 2019/0291176 A1 Sep. 26, 2019

(30) Foreign Application Priority Data

Oct. 26, 2016 (CN) ..... 201610942959.6

(51) Int. Cl.
*B22D 11/18* (2006.01)

(52) U.S. Cl.
CPC ..... *B22D 11/183* (2013.01); *B22D 11/18* (2013.01)

(58) Field of Classification Search
CPC ..... B22D 11/183; B22D 11/18; B22D 11/16; B22D 11/201; B22D 11/203
See application file for complete search history.

(56) References Cited

U.S. PATENT DOCUMENTS 5,884,685 A 3/1999 Umezawa et al.
2015/0190863 A1 7/2015 Tang et al.
(Continued)

FOREIGN PATENT DOCUMENTS

CA 2875892 A1 * 1/2014 ..... B22D 11/10
CN 101251749 8/2008
(Continued)

OTHER PUBLICATIONS

International Search Report & Writen Opinion dated Jan. 19, 2018 for PCT Patent Application No. PCT/CN2017/106043.
(Continued)

*Primary Examiner* — Scott R Kastler
(74) *Attorney, Agent, or Firm* — Lei Fang; Smith Tempel Blaha LLC

(57) ABSTRACT

A control method and apparatus for inhibiting slag entrapment in ladle (1) during continuous casting production. An optimal control model calculating unit (11) receives related signals and data sent by a ladle weight detector (4), a molten steel flow field detector (5), a slag detector (7), a sliding gate opening detector (9), and a process signal interface unit (10), performs calculation and analysis according to an optimal control model to obtain a corresponding optimal control strategy, and outputs the strategy to an electromagnetic brake (6) and a sliding gate controller (8) for slag entrapment inhibition control. Regarding the two processes where a vortex may be formed, by means of different optimal control strategies, which respectively inhibit or destroy the formation of a vortex, slag generation is postponed, and molten
(Continued)

steel may flow out without bringing slag out, thereby reducing residual ladle steel and improving molten steel yield.

3 Claims, 2 Drawing Sheets

(56) References Cited

U.S. PATENT DOCUMENTS

| | | | | |
|---|---|---|---|---|
| 2017/0216909 | A1* | 8/2017 | Lehman | B22D 11/04 |
| 2019/0291176 | A1* | 9/2019 | Shentu | F27B 3/19 |

FOREIGN PATENT DOCUMENTS

| | | | | |
|---|---|---|---|---|
| CN | 102921915 | | 2/2013 | |
| CN | 103192046 | | 7/2013 | |
| CN | 105195701 | | 12/2015 | |
| CN | 105983673 | | 10/2016 | |
| CN | 106987675 | A * | 7/2017 | |
| EP | 0249573 | A2 * | 12/1987 | B22D 11/183 |
| JP | S56154267 | | 11/1981 | |
| JP | 109253815 | | 9/1997 | |
| JP | H09236461 | | 9/1997 | |
| KR | 20150021967 | | 3/2015 | |

OTHER PUBLICATIONS

Office Action dated Jun. 16, 2020 for Korean Patent Application No. 1020197014894. English translation provided.

European Search Report dated Mar. 20, 2020 for European Patent Application No. 17866255.

Ozgu, Mustafa R. "Continuous caster instrumentation: State-of-the-art review." Canadian metallurgical quarterly 35.3 (1996): 199-223.

* cited by examiner

CONTROL METHOD AND APPARATUS FOR INHIBITING SLAG ENTRAPMENT IN LADLE IN LAST STAGE OF POURING DURING CONTINUOUS CASTING

CROSS-REFERENCE TO RELATED APPLICATIONS

This application is a 371 U.S. National Phase of PCT International Application No. PCT/CN2017/106043 filed on Oct. 13, 2017, which claims benefit and priority to Chinese patent application no. 201610942959.6 filed on Oct. 26, 2016. Both of the above-referenced applications are incorporated by reference herein in their entireties.

TECHNICAL FIELD

The disclosure relates to a control method and apparatus for inhibiting slag entrapment in a steel ladle in continuous casting production, particularly to a control method and apparatus for inhibiting slag entrapment at the last phase of ladle teeming in a continuous casting process.

BACKGROUND ART

In continuous casting production, firstly molten steel flows into a tundish from a ladle. Subsequently, the molten steel is distributed from the tundish into a plurality of molds where the molten steel is solidified and crystallized, and then drawn into a casting billet. As the molten steel flows from the ladle into the tundish, the liquid level of the molten steel in the ladle lowers gradually as the teeming proceeds. Near the end of the teeming, the steel slag in the ladle will flow together with the molten steel into the tundish through a long nozzle to form roughing slag. Excessive steel slag will not only reduce the cleanliness of the molten steel, affect the quality of the casting billet, even lead to a breaking out accident, but also accelerate corrosion of the refractory material of the tundish, shorten its service life, increase the weight of the slag crust in the tundish, and affect the continuous casting production.

In order to reduce the adverse effects caused by the excessive steel slag flowing out of the ladle, a manual or automatic roughing slag detection means is employed in an existing continuous casting production line to judge the occurrence of steel slag. When it is detected that the steel slag exceeds a value specified for the process, a slide gate nozzle is closed in time to end the teeming. However, at this moment, there is still a large amount of clean molten steel left in the ladle. According to long-term statistics on the amount of ladle slag that is dumped after ladle teeming ends on a continuous casting production line, an average remaining casting residue (molten steel+steel slag) for a 150-ton ladle is 4 tons or more, 2 tons or more of which is clean molten steel. An average casting residue for a 300-ton ladle is 6 tons, 3 tons or more of which is clean molten steel. All of such molten steel is generally treated as steel slag, resulting in enormous waste of resources. The reason why a large amount of molten steel remains in the ladle at the end of the ladle teeming is that the molten steel induces a rotary motion in the ladle at the middle to late phases of the teeming, and finally a vortex is formed above the tap hole, so that the steel slag floating at the surface of the molten steel is dragged down by the suction force of the vortex.

As regards the problem of slag entrapment caused by vortex suction at the middle to late phases of ladle teeming during continuous casting, there are some methods that are used to inhibit the phenomenon of slag entrapment to reduce residual steel in the ladle, such as tilted-ladle teeming method in which the whole ladle is tilted to a certain angle at the late phase of ladle teeming, so that the molten steel is biased to one side, thereby increasing the height of the molten steel and allowing more molten steel to flow out; ladle slag weir technology in which some raised slag weirs are disposed at the bottom of the ladle for slowing the flow speed of the molten steel at the late phase, thereby weakening the slag entrapment phenomenon. However, the effects of these methods are not satisfactory in practical applications. Up to now, there is still no effective means for inhibiting slag entrapment and reducing residual steel in a ladle in a teeming operation of continuous casting production at home and abroad.

SUMMARY

An object of the present disclosure is to provide a control method and apparatus for inhibiting slag entrapment at a final phase of ladle teeming in a continuous casting process, which can effectively inhibit the phenomenon of slag entrapment caused by vortex suction in the ladle at middle to late phases of the ladle teeming and realize optimal control over teeming. Therefore, the residual steel is reduced when the ladle teeming is finished, and thus the molten steel yield is increased.

To achieve the above technical object, the disclosure utilizes the following technical solution.

A control method for inhibiting slag entrapment at a final phase of steel ladle teeming in a continuous casting process, comprising the following steps:

(1) Collecting a type code of a steel being molten and teemed and a weight of a ladle itself to obtain a viscosity property of the molten steel and a dead weight of the ladle;

(2) Measuring a total weight of the ladle, subtracting the dead weight of the ladle from said total weight to obtain a net weight of the molten steel, and calculating an actual liquid level of the molten steel in the ladle based on a shape and a size of the ladle;

(3) Judging whether a slag entrapment control process should be performed based on the liquid level of the molten steel; if a condition is met, proceeding to a next step; otherwise, returning to step (2) to continue with the measurement;

(4) Measuring the molten steel for its current vortex surface size and vortex height using a device for measuring a distribution of a molten steel flow field;

(5) Measuring a nozzle opening degree using a device for measuring a slide gate nozzle opening degree of a ladle;

(6) Measuring a current steel slag content using a steel slag detecting device;

(7) Judging whether a roughing slag has been dragged in based on the steel slag content; if a condition indicating the roughing slag is met, proceeding to step (9) to perform a control process for destroying the vortex; otherwise, proceeding to step (8) to perform a control process for inhibiting the vortex;

(8) Performing the control process for inhibiting the vortex, which is an optimization control process in a period of time from start of formation of a dimple vortex at a surface of the molten steel above a tap hole to formation of a through vortex, wherein a controlling parameter is calculated using an optimization model for inhibiting vortex based on the measured vortex surface size, vortex height, nozzle opening degree and steel slag content in combination with the viscosity property of the molten steel, and an electromagnetic brake is actuated to generate a disturbing force opposite to a flow direction of the molten steel to inhibit the newly formed dimple vortex, and delay the formation of the through vortex, so that the occurrence of roughing slag is delayed, and residual molten steel in the ladle is reduced;

(9) Performing the control process for destroying the vortex, which is an optimization control process after formation of the through vortex, wherein an controlling parameter of the slide gate nozzle and an electromagnetic force are calculated using an optimization model for destroying vortex based on the measured data of vortex surface size, vortex height, nozzle opening degree in combination with the viscosity property of the molten steel, and the slide gate nozzle and the electromagnetic brake are controlled jointly to dissipate or shift the formed through vortex and weaken a suction force of the vortex, so that slag entrapment is prevented, the slag is left in the ladle, and the molten steel is allowed to flow out.

A control device for inhibiting slag entrapment at a final phase of steel ladle teeming in a continuous casting process, comprising: a ladle weight detector, a molten steel flow field distribution detector, an electromagnetic brake, a steel slag detector, a slide gate nozzle controller, a slide gate nozzle opening degree detector, a process signal interface unit, and an optimization control model calculation unit;

wherein the ladle weight detector is a weight measuring sensor installed on a ladle turret for real-time measurement of the weight of the ladle being in teeming operation, and outputting the weight value to the optimization control model calculation unit; the molten steel flow field distribution detector is a measuring device which is arranged in the ladle for measuring the formation of the molten steel vortex in the ladle at the time, measuring the vortex surface size and the vortex height, and transmitting the measurement results to the optimization model calculation unit in real time; the electromagnetic brake is a device for generating an electromagnetic force, installed near the tap hole of the ladle for generating a force opposite to the flow direction of the molten steel, and receiving output control of the optimization control model calculation unit; the steel slag detector is a sensor for measuring a percentage of the steel slag, installed above the slide gate nozzle for real-time measurement of a content of the steel slag contained in the molten steel flowing over the slide gate nozzle at the time, and outputting the measurement result to the optimization control model calculation unit; the slide gate nozzle controller is a device that drives the slide gate nozzle into motion for controlling opening and closing actions of the slide gate nozzle, and receives output control from the control model calculation unit; the slide gate nozzle opening degree detector is a device for measuring an opening degree of the slide gate nozzle at the time, and the detected result is also transmitted to the optimization control model calculation unit in real time, wherein the molten steel flows from the ladle through the slide gate nozzle to the tundish, and the opening degree of the slide gate nozzle refers to a flux of the molten steel flowing therethrough; the process signal interface unit is a signal conversion device having two functions, one of which is to convert the signal information of the type of the steel currently teemed into a code, the other of which is to receive a signal of a net weight of the ladle in teeming operation at the time, and output the information to the optimization control model calculation unit; the optimization control model calculation unit is a computer device having functions of data acquisition, model calculation optimization and output control, which receives relevant signals and data transmitted from the ladle weight detector, the molten steel flow field distribution detector, the steel slag detector, the slide gate nozzle opening degree detector, and the process signal interface unit, and conducts calculation and analysis based on the optimization control model to obtain a corresponding optimization control strategy that is output to the electromagnetic brake and slide gate nozzle controller for inhibiting slag entrapment.

In the control method and apparatus for inhibiting slag entrapment at a final phase of ladle teeming in a continuous casting process according to the present disclosure, the formation processes of the vortex in the ladle at the middle to late phases of the ladle teeming in the continuous casting process are analyzed. For the two processes of vortex formation, different optimization control strategies are adopted, wherein occurrence of roughing slag is delayed by inhibiting and destroying the formation of vortex respectively, so that outflow of molten steel without slag is achieved, thereby reducing residual steel in the ladle and increasing the yield of the molten steel.

According to the disclosure, at the middle to late phases of the ladle teeming, the phenomenon of slag entrapment by vortex suction in the ladle can be inhibited effectively, and optimal control over the teeming can be realized, thereby reducing residual steel in the ladle after the teeming is finished, and the yield of the molten steel can be thus increased.

DESCRIPTION OF THE DRAWINGS

FIG. 2 is a schematic view of slag entrapment by vortex, wherein: FIG. 2(*a*) shows the slag entrapment by a dimple vortex, and FIG. 2(*b*) shows the slag entrapment by a through vortex;

Figure 1:
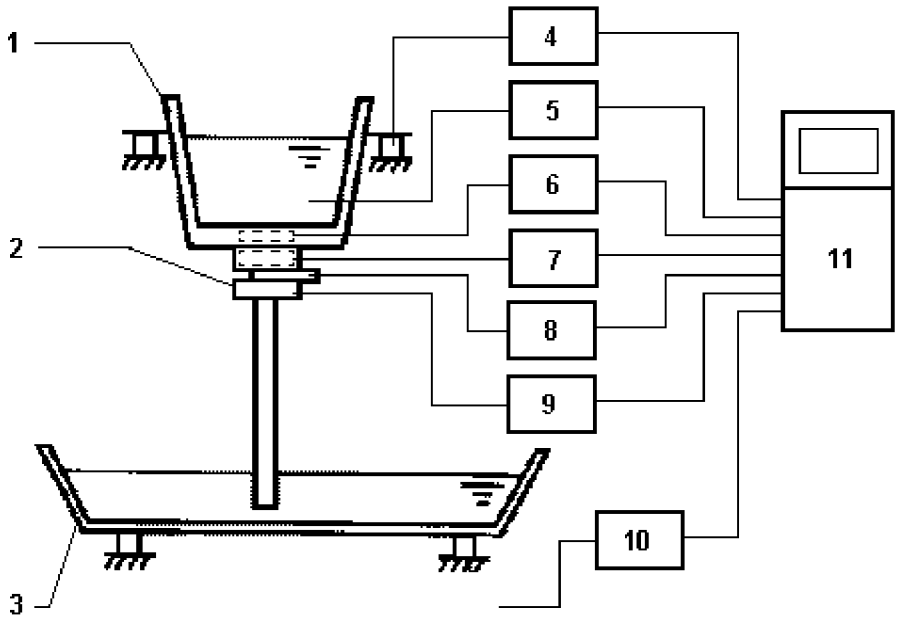
FIG. 1 is a schematic view of a control device for inhibiting slag entrapment at the final phase of ladle teeming in a continuous casting process according to the present disclosure.

In the drawings: 1 ladle, 2 slide gate nozzle, 3 tundish, 4 ladle weight detector, 5 molten steel flow field distribution detector, 6 electromagnetic brake, 7 steel slag detector, 8 slide gate nozzle controller, 9 slide gate nozzle opening degree detector, 10 process signal interface unit, 11 optimization control model calculation unit.

DETAILED DESCRIPTION

The invention will be further illustrated with reference to the accompanying drawings and the specific embodiments.

Referring to FIG. 1, a control device for inhibiting slag entrapment at a final phase of ladle teeming in a continuous casting process comprises: a ladle weight detector 4, a molten steel flow field distribution detector 5, an electromagnetic brake 6, a steel slag detector 7, a slide gate nozzle controller 8, a slide gate nozzle opening degree detector 9, a process signal interface unit 10, and an optimization control model calculation unit 11.

The ladle weight detector 4 is a weight measuring sensor installed on a ladle 1 turret for real-time measurement of the weight of the ladle being in teeming operation, and outputting the weight value to the optimization control model calculation unit 11.

The molten steel flow field distribution detector 5 is a measuring device which is arranged in the ladle 1 and mainly functions to measure the formation of the molten steel vortex in the ladle at the time, measure the vortex surface size and the vortex height, and transmit the measurement results to the optimization model calculation unit 11 in real time, wherein the molten steel flow field distribution detector 5 is a patented product bearing a patent number of 2014102836130.

The electromagnetic brake 6 is a device for generating an electromagnetic force, wherein it is installed near the tap hole of the ladle for generating a force opposite to the flow direction of the molten steel, and receives output control signal from the optimization control model calculation unit 11.

The steel slag detector 7 is a sensor for measuring a percentage of the steel slag, wherein it is installed above the slide gate nozzle 2 for real-time measurement of a content of the steel slag contained in the molten steel flowing over the slide gate nozzle at the time, and outputs the measurement result to the optimization control model calculation unit 11.

The slide gate nozzle controller 8 is a device that drives the slide gate nozzle into motion for controlling opening and closing actions of the slide gate nozzle, and receives output control signal from the control model calculation unit 11.

The slide gate nozzle opening degree detector 9 is a device for measuring an opening degree of the slide gate nozzle at the time, and the detected result is also transmitted to the optimization control model calculation unit 11 in real time. The meaning of the slide gate nozzle opening degree may be clarified herein. As the molten steel flows from the ladle through the slide gate nozzle to the tundish, the opening degree of the slide gate nozzle refers to a flux of the molten steel flowing therethrough.

The process signal interface unit 10 is a signal conversion device having two functions, one of which is to convert the signal information of the type of the steel currently teemed into a code, the other of which is to receive a signal of a net weight of the ladle in teeming operation at the time, and output the information to the optimization control model calculation unit 11.

The optimization control model calculation unit 11 is a computer device having functions of data acquisition, model calculation optimization and output control, which receives relevant signals and data transmitted from the ladle weight detector 4, the molten steel flow field distribution detector 5, the steel slag detector 7, the slide gate nozzle opening degree detector 9 and the process signal interface unit 10, and conducts calculation and analysis based on the optimization control model to obtain a corresponding optimization control strategy that is output to the electromagnetic brake 6 and slide gate nozzle controller 8 for inhibiting slag entrapment.

Figure 2:
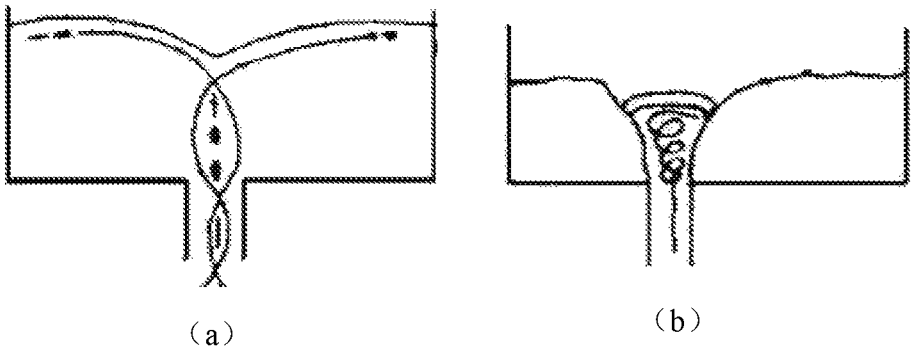

Referring to FIG. 2, in the continuous casting production process, the liquid level of the molten steel in the ladle lowers gradually as the ladle teeming proceeds. At the middle to late phases of the teeming, the molten steel generates a swirling flow in the ladle, and a vortex is formed above the tap hole. During the ladle teeming in the continuous casting process, the formation of the vortex in the ladle and the slag entrapment by vortex are extremely complex, and mainly two processes are involved.

The first process is formation of a dimple vortex above the tap hole, as shown in FIG. 2(*a*). At the beginning, only a small dimple vortex is formed. At this time, the vortex is relatively small and has not fully formed. Hence, the suction force is relatively weak, and only a small amount of steel slag is whirled down. This slag is so-called intermediate slag in the process.

The second process is a process in which a through vortex is formed ultimately as the dimple vortex gets larger and larger gradually. As shown in FIG. 2(*b*), a full vortex is formed at this time. The suction force is relatively large, and a large amount of steel slag is whirled down. This slag is so-called roughing slag in the process.

Figure 3:
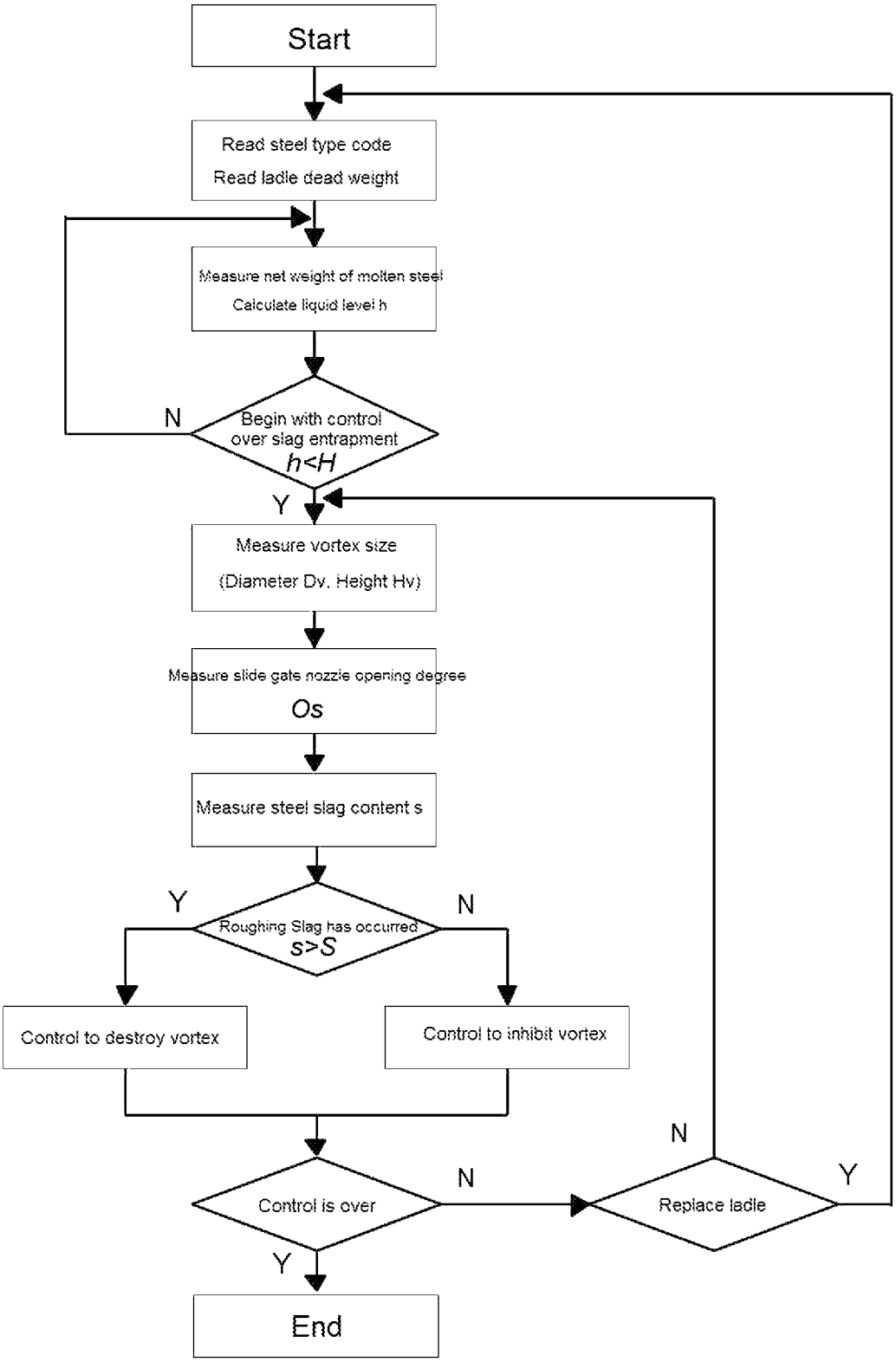
FIG. 3 is a flow chart of the control method for inhibiting slag entrapment at the final phase of ladle teeming of a continuous casting process according to the present disclosure.

The control method for inhibiting the slag entrapment at the final phase of ladle teeming in a continuous casting process according the present disclosure is implemented on the basis of the above control apparatus for inhibiting slag entrapment and the vortex forming process in teeming. The control flow is shown in FIG. 3. The control method comprises the following steps:

In the first step, the optimization model calculation unit 11 reads the type code of the steel being teemed and the dead weight of the ladle through the process signal interface unit 10;

In the second step, the current ladle weight is measured using the ladle weight detector 4 installed on the ladle 1 turret, and the measurement result is transmitted to the optimization model calculation unit 11 which calculates the current net weight of the molten steel in the ladle based on the existing dead weight of the ladle, and calculates the current molten steel level h in the ladle according to the shape and size of the ladle;

In the third step, the optimization model calculation unit 11 determines whether the current molten steel level meets the condition to activate control over slag entrapment, that is, whether the molten steel level h is less than H, wherein H is a constant which is a height value set according to the characteristics of a specific continuous casting production line: when the molten steel level h meets the condition to activate control over slag entrapment, proceed to the fourth step; otherwise, return to the second step;

The fourth step, the current vortex surface size and vortex height of the molten steel in the ladle are measured using the molten steel flow field distribution detector 5, and the measurement results are output to the optimization model calculation unit 11;

The fifth step, the current opening degree of the slide gate nozzle 2 is measured using the slide gate nozzle opening degree detector 9, and the measurement result is output to the optimization model calculating unit 11;

In the sixth step, the current content s of the steel slag flowing through the nozzle outlet is measured using the steel slag detector 7, and the measurement result is output to the optimization model calculation unit 11;

In the seventh step, it is determined whether the roughing slag has occurred based on the content of the steel slag, that is, whether the current content s of the steel slag is larger than S, wherein S is the roughing slag alarm value set according to the requirement of the current continuous casting production: when the content s of the steel slag meets the roughing slag condition, proceed to the ninth step to perform the control process of destroying the vortex; otherwise, proceed to the eighth step to perform the control process of inhibiting the vortex;

In the eighth step, the control process for inhibiting the vortex is performed, which is the control in the period of time from the start of the formation of the dimple vortex to the formation of the through vortex above the tap hole. This process utilizes a control method that inhibits the formation of the vortex, that is, delays the formation of the through vortex. As a result, the occurrence of the rough slag is delayed, and the residual molten steel in the ladle is reduced. The specific control process is as follows: after the data of the vortex surface size, the vortex height, the slide gate nozzle opening degree and the steel slag content are obtained, a controlling parameter is calculated using an optimization model for inhibiting vortex based on the above data in combination with the viscosity property of the molten steel, and the electromagnetic brake 6 is actuated to generate a disturbing force opposite to the flow direction of the molten steel to suppress the newly formed dimple vortex, retard it from becoming larger and stronger, and delay the formation of the through vortex. The equation for calculating the controlling parameter of the disturbing force is as follows:

$$F = K \cdot \left( mD_v + n\frac{H_v^2}{h} \right) \cdot aO_s \cdot bs \cdot c\mu$$

wherein: F is the controlling parameter of the current disturbing force;

K is a correction coefficient for calculating the disturbing force, which is a constant determined according to the size of the tap hole at the bottom of the ladle;

$D_v$ is a diameter of the vortex surface of the current vortex;

$H_v$ is the current vortex height;

h is the current molten steel level in the ladle;

$O_s$ is the current opening degree of the slide gate nozzle;

s is the content of the steel slag currently flowing through the nozzle outlet;

μ is the viscosity of the molten steel currently teemed;

m, n, a, b, and c are correction coefficients of the vortex surface diameter, the vortex height, the nozzle opening degree, the steel slag content, and the molten steel viscosity. These correction coefficients are all constants that need to be determined according to the equipment parameters of a specific continuous caster. Among these coefficients, m and n are determined according to the diameter of the bottom of the ladle; a is determined according to the size of the nozzle when the nozzle is fully opened; b is determined according to the size of the tap hole; c is determined according to the temperature range of the molten steel in the ladle.

In the ninth step, the control process for destroying the vortex is performed, which is the control after the formation of the through vortex, that is, after the occurrence of the roughing slag. This process utilizes a control method that destroys the vortex by dissipating or shifting the formed through vortex and weakening the suction force of the vortex, so as to prevent slag entrapment, leave the steel slag in the ladle, and allow the molten steel to flow out. After the occurrence of the roughing slag, the vortex is fully formed and goes through the ladle, and the suction force is large. The electromagnetic brake alone is unable to destroy the vortex. Therefore, it is necessary to simultaneously employ the electromagnetic brake and the opening/closing action of the slide gate nozzle to realize the control in this process. The specific control process is as follows: after the data of the vortex surface size, the vortex height, the slide gate nozzle opening degree, the viscosity property of the molten steel and the like are obtained, the controlling parameters of the slide gate nozzle and the electromagnetic force are calculated using the optimization model for destroying the vortex, and then the slide gate nozzle controller 8 is actuated to generate a rapid oscillating action, and the electromagnetic brake 6 is actuated to generate a force opposite to the flow direction of the molten steel to destroy the formed through vortex. The equation for calculating the controlling parameter of the slide gate nozzle is as follows:

$$L = M \cdot iD_v^2 \cdot jH_v \cdot e\left( \frac{O_s}{1 - O_s + f} \right)^{\frac{3}{2}} \cdot g\mu$$

wherein: L is the oscillating amplitude of the slide gate nozzle to be controlled;

M is the correction coefficient for calculating the nozzle controlling parameter, which is a constant determined according to the level of control set by a user;

$D_v$ is the diameter of the vortex surface of the current vortex;

$H_v$ is the current vortex height;

$O_s$ is the current slide gate nozzle opening degree;

μ is the viscosity of the molten steel currently teemed;

j, e, f, g are correction coefficients for the vortex surface diameter, the vortex height, the nozzle opening degree, the nozzle opening degree compensation, and the molten steel viscosity. These correction coefficients are all constants that need to be determined according to the equipment parameters of a specific continuous caster. Among these coefficients, i and j are determined according to the diameter of the bottom of the ladle; e and f are determined according to the size of the nozzle fully opened and the total stroke of the nozzle; g is determined according to the temperature range of the molten steel in the ladle.

The equation for calculating the controlling parameter of the electromagnetic force is as follows:

$$F' = N \cdot (pD_v + qH_v) \cdot hO_s \cdot rs \cdot t\mu$$

wherein: F' is the controlling parameter of the current electromagnetic force;

N is a correction coefficient for calculating the electromagnetic force, and this coefficient is a constant determined according to the size of the tap hole at the bottom of the ladle;

$D_v$ is the diameter of the vortex surface of the current vortex;

$H_v$ is the current vortex height;

$O_s$ is the current slide gate nozzle opening degree;

s is the content of the steel slag currently flowing through the nozzle outlet;

μ is the viscosity of the molten steel currently teemed;

p, q, h, r, and t are correction coefficients for the vortex surface diameter, the vortex height, the nozzle opening degree, the steel slag content, and the molten steel viscosity. These correction coefficients are all constants that need to be determined according to the equipment parameters of a specific caster. Among these coefficients, p and q are determined according to the diameter of the bottom of the ladle; h is determined according to the size of the nozzle fully opened; r is determined according to the size of the tap hole; t is determined according to the temperature range of the molten steel in the ladle.

In the tenth step, it is judged whether the control flow should be ended. If the ending condition is satisfied, the flow is exited, and the control process is terminated. Otherwise, it is judged whether the ladle shall be replaced, as a different ladle means to start new teeming all over again. The new ladle may have a different dead weight, and thus it's necessary to acquire the dead weight value of the new ladle after the replacement. At the same time, the steel type of the new ladle may be different too, and it's necessary to collect information about the new type of steel. In this case, the control flow returns to the first step, and the above steps are repeated. If the ladle is not replaced after inspection, the control flow returns to the fourth step, and the above steps are repeated.

The above description only reveals some preferred embodiments of the disclosure, with no intention to limit the protection scope of the disclosure. Therefore, all changes, equivalents, modifications within the spirit and principles of the disclosure are included in the protection scope of the disclosure.

The invention claimed is:

1. A control method for inhibiting slag entrapment at a final phase of ladle teeming in a continuous casting process, comprising the following steps:

(1) Reading a code of signal information of a type of a steel being teemed and obtaining a viscosity of a molten steel and a dead weight of the ladle;

(2) Measuring a total weight of the ladle and subtracting the dead weight of the ladle from said total weight of the ladle to obtain a net weight of the molten steel, and calculating an actual liquid level h of the molten steel in the ladle according to a shape and a size of the ladle;

(3) Determining whether the liquid level h of the molten steel is less than a constant H which is a height value set according to the characteristics of a specific continuous casting production line; if h is lower than H, proceeding to step (4), otherwise, returning to step (2) to continue with the measurement;

(4) Measuring a current vortex surface size and a vortex height of the molten steel, a nozzle opening degree of the ladle, and a current steel slag content;

(5) Determining whether a roughing slag has been occurred based on the steel slag content, that is, whether the current content s of the steel slag is larger than S, wherein S is a roughing slag alarm value set according to the requirement of a current continuous casting production; if s is larger than S, proceeding to step (7) to perform a control process for destroying the vortex; otherwise, proceeding to step (6) to perform a control process for inhibiting vortex;

(6) Performing a control process for inhibiting vortex, comprising calculating a controlling parameter of a disturbing force, actuating an electromagnetic brake to generate the disturbing force opposite to a flow direction of the molten steel to inhibit a newly formed dimple vortex and to delay formation of a through vortex; wherein the controlling parameter of the disturbing force is calculated using the following equation:

$$F = K \cdot \left( mD_v + n\frac{H_v^2}{h} \right) \cdot aO_s \cdot bs \cdot c\mu$$

wherein: F is the control parameter of the current disturbing force;

K is a correction coefficient for calculating the disturbing force;

$D_v$ is a diameter of the vortex surface of the current vortex;

$H_v$ is the current vortex height;

h is the current liquid level of the molten steel in the ladle;

$O_s$ is the current slide gate nozzle opening degree;

s is the content of the steel slag currently flowing through the nozzle outlet;

μ is the viscosity of the molten steel currently teemed;

m, n, a, b, and c are correction coefficients for the vortex surface diameter, the vortex height, the nozzle opening degree, the steel slag content, and the molten steel viscosity;

(7) Performing a control process for destroying vortex, comprising calculating a controlling parameter of a slide gate nozzle and an electromagnetic force, actuating a slide gate nozzle controller to generate a rapid oscillating action and actuating an electromagnetic brake to generate a force opposite to the flow direction of the molten steel to destroy the formed through vortex, wherein the controlling parameter of the slide gate nozzle is calculated using the following equation:

$$L = M \cdot iD_v^2 \cdot jH_v \cdot e\left( \frac{O_s}{1 - O_s + f} \right)^{\frac{3}{2}} \cdot g\mu$$

wherein: L is an oscillating amplitude of the slide gate nozzle to be controlled;

M is a correction coefficient for calculating the controlling parameter of the nozzle;

$D_v$ is a diameter of the vortex surface of the current vortex;

$H_v$ is the current vortex height;

$O_s$ is the current slide gate nozzle opening degree;

μ is the viscosity of the molten steel currently teemed;

j, e, f, g are correction coefficients for the vortex surface diameter, the vortex height, the nozzle opening degree, the nozzle opening degree compensation, and the molten steel viscosity.

2. The control method of claim 1, wherein the electromagnetic force is calculated using the following equation:

$$F' = N \cdot (pD_v + qH_v) \cdot hO_s \cdot rs \cdot t\mu$$

wherein: F' is the control parameter of the current electromagnetic force;

N is a correction coefficient for calculating the electromagnetic force;

$D_v$ is a diameter of the vortex surface of the current vortex;

$H_v$ is the current vortex height;

$O_s$ is the current slide gate nozzle opening degree;

s is the content of the steel slag currently flowing through the nozzle outlet;

μ is the viscosity of the molten steel currently teemed;

p, q, h, r, and t are correction coefficients for the vortex surface diameter, the vortex height, the nozzle opening degree, the steel slag content, and the molten steel viscosity.

3. A control apparatus for inhibiting slag entrapment at a final phase of ladle teeming in a continuous casting process, comprising:

a ladle weight detector (4), a molten steel flow field distribution detector (5), an electromagnetic brake (6), a steel slag detector (7), a slide gate nozzle controller (8), a slide gate nozzle opening degree detector (9), a process signal interface unit (10), and an optimization control model calculation unit (11);

wherein the ladle weight detector (4) is a weight measuring sensor installed on a ladle (1) turret for real-time measurement of a weight of the ladle being in teeming operation, and outputting a weight value to the optimization control model calculation unit (11);

the molten steel flow field distribution detector (5) is a measuring device which is arranged in the ladle (1) for measuring formation of a current molten steel vortex in the ladle, measuring a vortex surface size and a vortex height, and transmitting measurement results to the optimization control model calculation unit (11) in real time;

the electromagnetic brake (6) is a device for generating an electromagnetic force, wherein it is installed near a tap hole of the ladle (1) for generating a force opposite to a flow direction of the molten steel, and receives output control from the optimization control model calculation unit (11);

the steel slag detector (7) is a sensor for measuring a steel slag content by percentage, installed above a slide gate nozzle (2) for real-time measurement of an amount of steel slag contained in the molten steel currently flowing over the slide gate nozzle, and outputting a measurement result to the optimization control model calculation unit (11);

the slide gate nozzle controller (8) is a device connecting to slide gate nozzle to drive the slide gate nozzle into motion for controlling opening and closing actions of the slide gate nozzle and to the optimization control model calculation unit (11) to receive output control from the optimization control model calculation unit (11);

the slide gate nozzle opening degree detector (9) is a device for measuring a current opening degree of the slide gate nozzle, which connects to the optimization control model calculation unit (11) to transmit a detected result to the optimization control model calculation unit (11) in real time; wherein the current opening degree of the slide gate nozzle refers to a flux of the molten steel flowing through the slide gate nozzle (2) from the ladle (1) to a tundish (3);

the process signal interface unit (10) is a signal conversion device for converting signal information of a type of a steel currently teemed into a code and receiving a signal of a current net weight of the ladle in teeming operation, which connects to the optimization control model calculation unit (11) to output the code and the signal of the current net weight of the ladle to the optimization control model calculation unit (11);

the optimization control model calculation unit (11) is a computer device having functions of data acquisition, model calculation optimization and output control, which connects to the ladle weight detector (4), the molten steel flow field distribution detector (5), the steel slag detector (7), the slide gate nozzle opening degree detector (9), and the process signal interface unit (10), and receives relevant signals and data transmitted from the ladle weight detector (4), the molten steel flow field distribution detector (5), the steel slag detector (7), the slide gate nozzle opening degree detector (9), and the process signal interface unit (10), and conducts calculation and analysis based on the optimization control model to obtain a corresponding optimization control strategy that is output to the electromagnetic brake (6) and slide gate nozzle controller (8) for inhibiting slag entrapment.

* * * * *